US008911222B2

(12) United States Patent
Walgren et al.

(10) Patent No.: US 8,911,222 B2
(45) **Date of Patent: *Dec. 16, 2014**

(54) INPUT SHAFT ASSEMBLY FOR GEAR PUMP

(75) Inventors: Timothy P. Walgren, Byron, IL (US); Satish Shantilal Shah, Rockford, IL (US); Steven A. Heitz, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 810 days.

This patent is subject to a terminal disclaimer.

(21) Appl. No.: 13/034,943

(22) Filed: Feb. 25, 2011

(65) Prior Publication Data

US 2012/0219446 A1 Aug. 30, 2012

(51) Int. Cl.

| | |
|---|---|
| ***F01C 1/18*** | (2006.01) |
| ***F04C 2/14*** | (2006.01) |
| ***F04C 15/00*** | (2006.01) |
| ***F01C 21/00*** | (2006.01) |
| ***F01C 19/00*** | (2006.01) |

(52) U.S. Cl.

CPC ..... *F01C 19/005* (2013.01); *F04C 15/0038* (2013.01); *F04C 15/0092* (2013.01); *F04C 2/14* (2013.01); *F04C 15/0073* (2013.01); *F04C 2240/603* (2013.01); *F01C 21/007* (2013.01)

USPC ..... 418/205; 418/206.8; 464/179; 464/183

(58) Field of Classification Search

USPC ..... 418/83, 91, 94, 205, 206.8; 464/179, 464/183, 182

See application file for complete search history.

(56) References Cited

U.S. PATENT DOCUMENTS

| | | | | | |
|---|---|---|---|---|---|
| 1,626,557 | A | * | 4/1927 | Rolaff | 418/94 |
| 1,902,346 | A | | 3/1933 | Vogt | |
| 2,102,344 | A | * | 12/1937 | Wishart | 418/91 |
| 2,136,117 | A | * | 11/1938 | Nichols | 418/94 |
| 2,301,496 | A | | 11/1942 | Aldrich | |
| 3,018,641 | A | | 1/1962 | Carpigiani | |
| 3,045,778 | A | | 7/1962 | Mosbacher | |
| 3,182,596 | A | | 5/1965 | Prijatel | |
| 3,435,773 | A | | 4/1969 | Gustafsson | |
| 3,824,041 | A | | 7/1974 | Rystrom | |
| 3,833,317 | A | | 9/1974 | Rumsey | |
| 4,097,206 | A | | 6/1978 | Schonherr | |
| 4,290,739 | A | | 9/1981 | Korse | |
| 4,631,009 | A | | 12/1986 | Cygnor et al. | |
| 5,004,407 | A | | 4/1991 | Hutchison | |
| 5,071,328 | A | | 12/1991 | Schlictig | |
| 5,586,875 | A | | 12/1996 | Ondrejko et al. | |
| 6,135,741 | A | | 10/2000 | Oehman, Jr. | |
| 6,138,646 | A | | 10/2000 | Hansen et al. | |
| 6,223,775 | B1 | | 5/2001 | Hansen et al. | |
| 6,241,498 | B1 | | 6/2001 | Hansen et al. | |
| 6,321,527 | B1 | | 11/2001 | Dyer et al. | |
| 6,632,144 | B1 | * | 10/2003 | Narita et al. | 464/179 |
| 6,705,847 | B1 | | 3/2004 | Sagawe et al. | |
| 7,094,042 | B1 | | 8/2006 | Borgetti et al. | |

(Continued)

*Primary Examiner* — Mary A Davis

(74) *Attorney, Agent, or Firm* — Carlson, Gaskey & Olds, P.C.

(57) ABSTRACT

A shaft assembly includes a shaft with a first radial shoulder and a second radial shoulder. A retainer plate is located at least partially between the first radial shoulder and the second radial shoulder to avoid damage when an impact load is applied to the shaft. A spring assembly biases the shaft out of contact with the retainer plate during operation.

20 Claims, 13 Drawing Sheets

(56) References Cited

U.S. PATENT DOCUMENTS

| | | | |
|---|---|---|---|
| 7,878,781 | B2 | 2/2011 | Elder |
| 2002/0061256 | A1 | 5/2002 | Hansen et al. |
| 2006/0024188 | A1 | 2/2006 | Muscarella et al. |
| 2007/0178003 | A1 | 8/2007 | Zhu et al. |
| 2009/0148333 | A1 | 6/2009 | Elder |
| 2009/0159370 | A1 * | 6/2009 | Maners et al. ..... 464/16 |

* cited by examiner

INPUT SHAFT ASSEMBLY FOR GEAR PUMP

BACKGROUND

The present disclosure relates to a pump, and more particularly to a fuel gear pump for gas turbine engines.

Fuel gear pumps are commonly used to provide fuel flow and pressure for gas turbine engines and other systems on aircrafts. The gear pump must perform over a wide system operating range and provide critical flows and pressures for various functions. Typically, these pumps receive rotational power from an accessory gearbox through a drive shaft.

Oftentimes, impact loads may be applied to the pump when installed onto the accessory gearbox. To meet all performance requirements throughout the pump service life, the pump must withstand these periodic events without damage.

SUMMARY

A shaft assembly according to an exemplary aspect of the present disclosure includes a shaft with a first radial shoulder and a second radial shoulder. A retainer plate is located at least partially between the first radial shoulder and the second radial shoulder.

A shaft assembly according to an exemplary aspect of the present disclosure includes a shaft with a first radial shoulder and a second radial shoulder. A spring guide is in contact with the shaft, a first spring is between the spring guide and the shaft and a second spring is in contact with the spring guide.

A gear pump according to an exemplary aspect of the present disclosure includes an input shaft which at least partially extends from a pump housing, the input shaft defines a first radial shoulder and a second radial shoulder. A retainer plate is mounted to the pump housing. The retainer plate is located at least partially between the first radial shoulder and the second radial shoulder to restrain an axial position of the input shaft.

A method of installing an input shaft assembly within a housing according to an exemplary aspect of the present disclosure includes positioning an input shaft to at least partially extend from a housing along an input shaft axis, the input shaft defines a first radial shoulder and a second radial shoulder. Attaching a retainer plate to the housing, the retainer plate is located at least partially between the first radial shoulder and the second radial shoulder to restrain an axial position of the input shaft.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
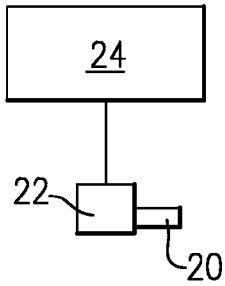
FIG. 1 is a block diagram of a gear pump driven by an accessory gearbox to communicate a fluid such as fuel to a gas turbine.

FIG. 1 schematically illustrates a gear pump 20 driven by an accessory gearbox 22 to communicate a fluid such as fuel to a gas turbine 24. It should be appreciated that the present application is not limited to use in conjunction with a specific system. Thus, although the present application is, for convenience of explanation, depicted and described as being implemented in an aircraft fuel pump, it should be appreciated that it can be implemented in numerous other systems. In addition, although a dual stage gear pump is disclosed, other machines with a shaft will also benefit herefrom.

Figure 2:
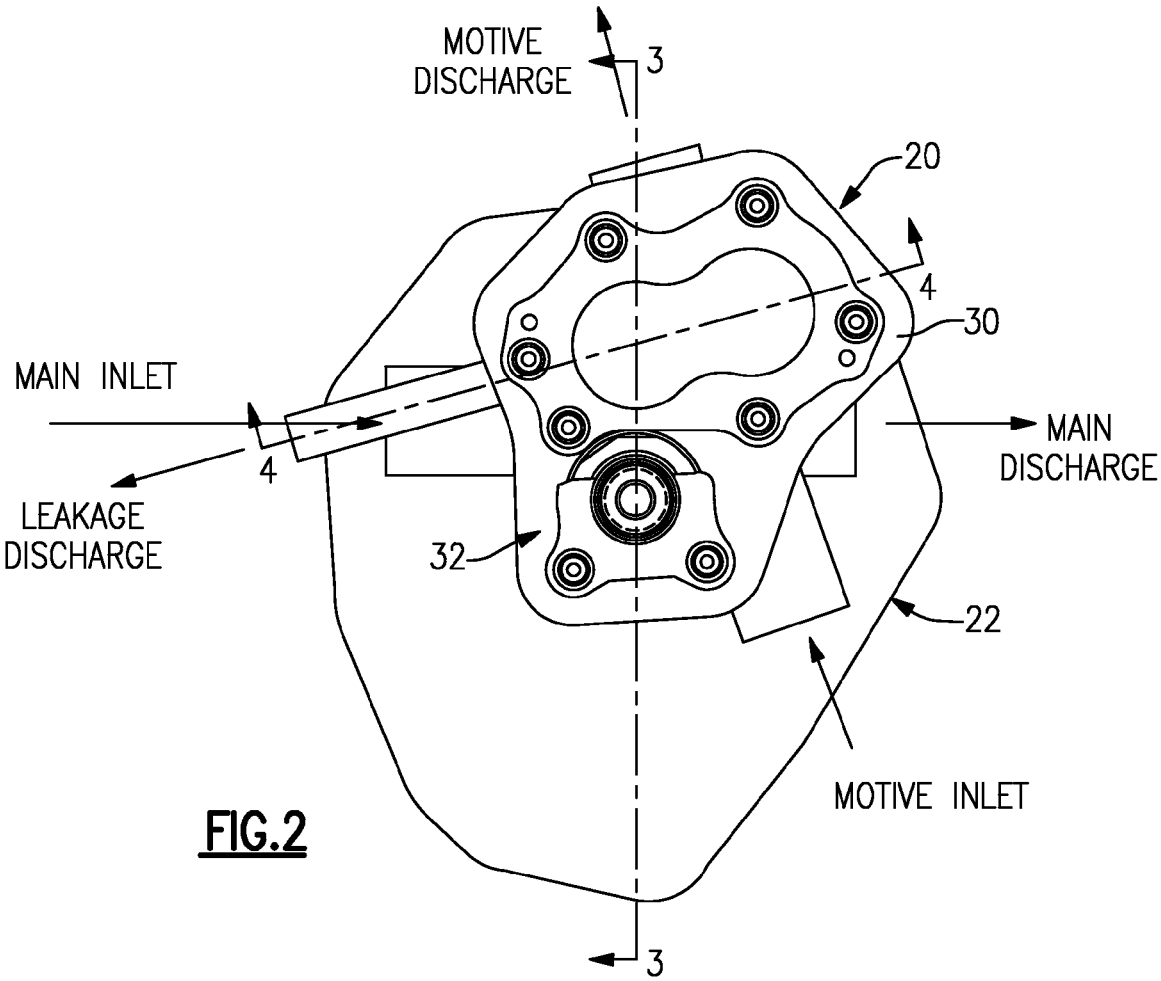
FIG. 2 is an end view of a gear pump.
Figure 3:
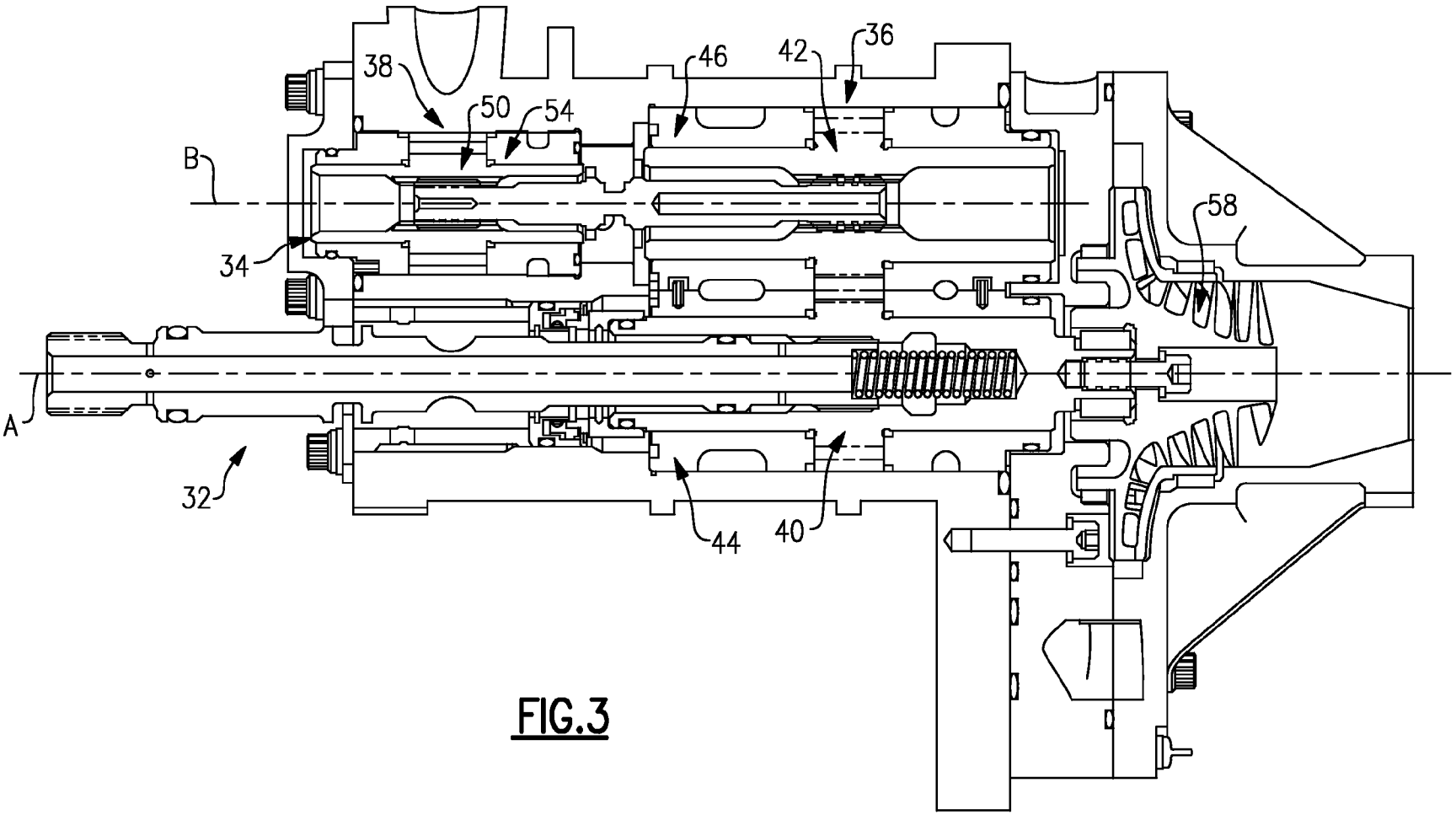
FIG. 3 is a sectional view of the gear pump taken along line 3-3 in FIG. 2.
Figure 4:
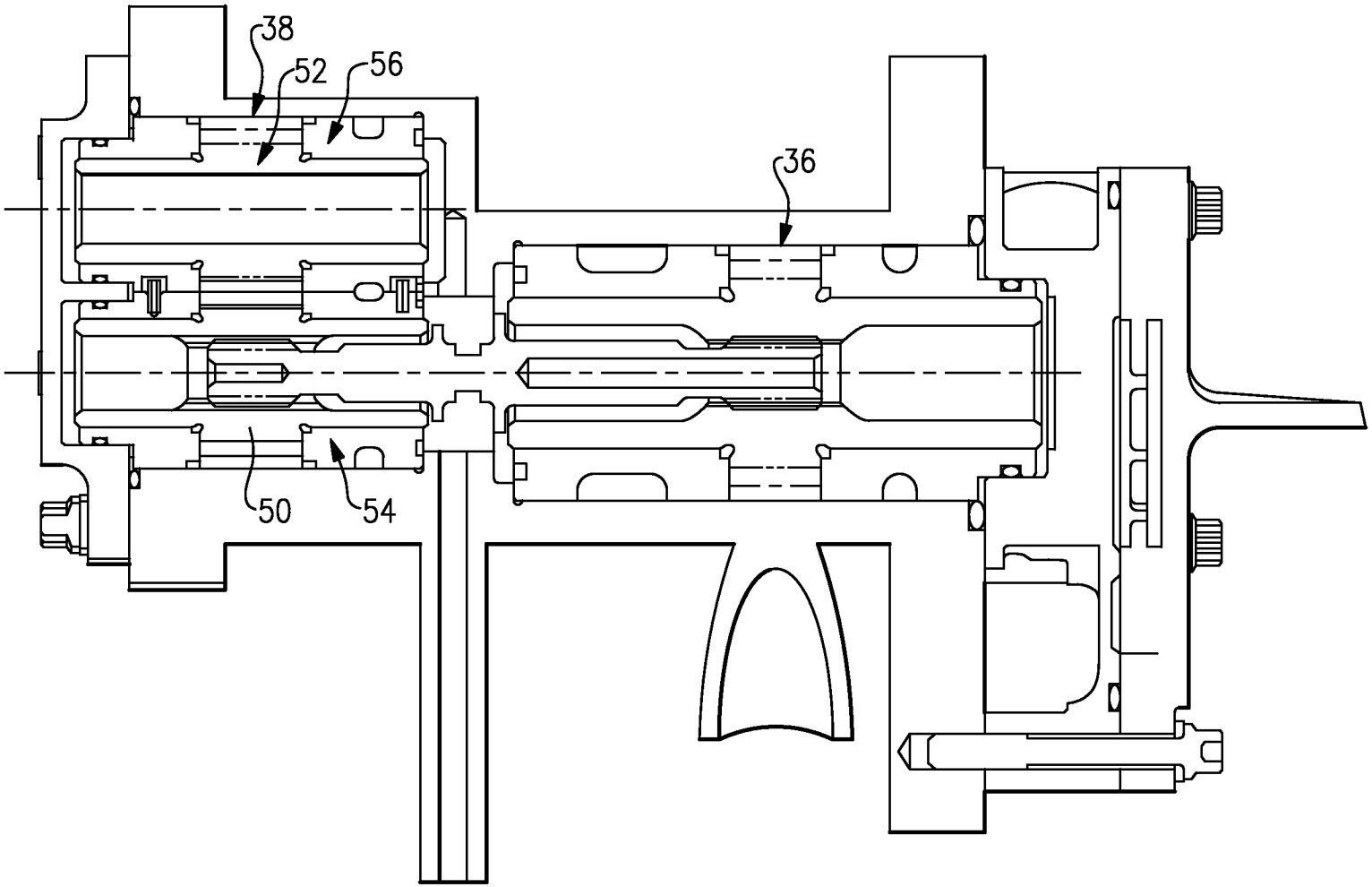
FIG. 4 is a sectional view of the gear pump taken along line 4-4 in FIG. 2.

With reference to FIG. 2, the gear pump 20 generally includes a housing 30 that includes an input shaft assembly 32 and a coupling shaft assembly 34 to power a main stage 36 and a motive stage 38 (FIGS. 3 and 4). Rotational power is transferred from the gas turbine 24 to the accessory gearbox 22 then to the gear pump 20 through the input shaft assembly 32. In the disclosed, non-limiting embodiment, the input shaft assembly 32 interfaces with the accessory gearbox 22 and receives a lubricant therefrom while the coupling shaft assembly 34 is lubricated with fuel.

With reference to FIG. 3, the input shaft assembly 32 is defined along an input axis A and the coupling shaft assembly 34 is defined along a coupling axis B parallel to the input axis A. The main stage 36 generally includes a main drive gear 40, a main driven gear 42, a main drive bearing 44 and a main driven bearing 46. The motive stage 38 generally includes a motive drive gear 50, a motive driven gear 52, a motive drive bearing 54 and a motive driven bearing 56 (FIG. 4).

Figure 5:
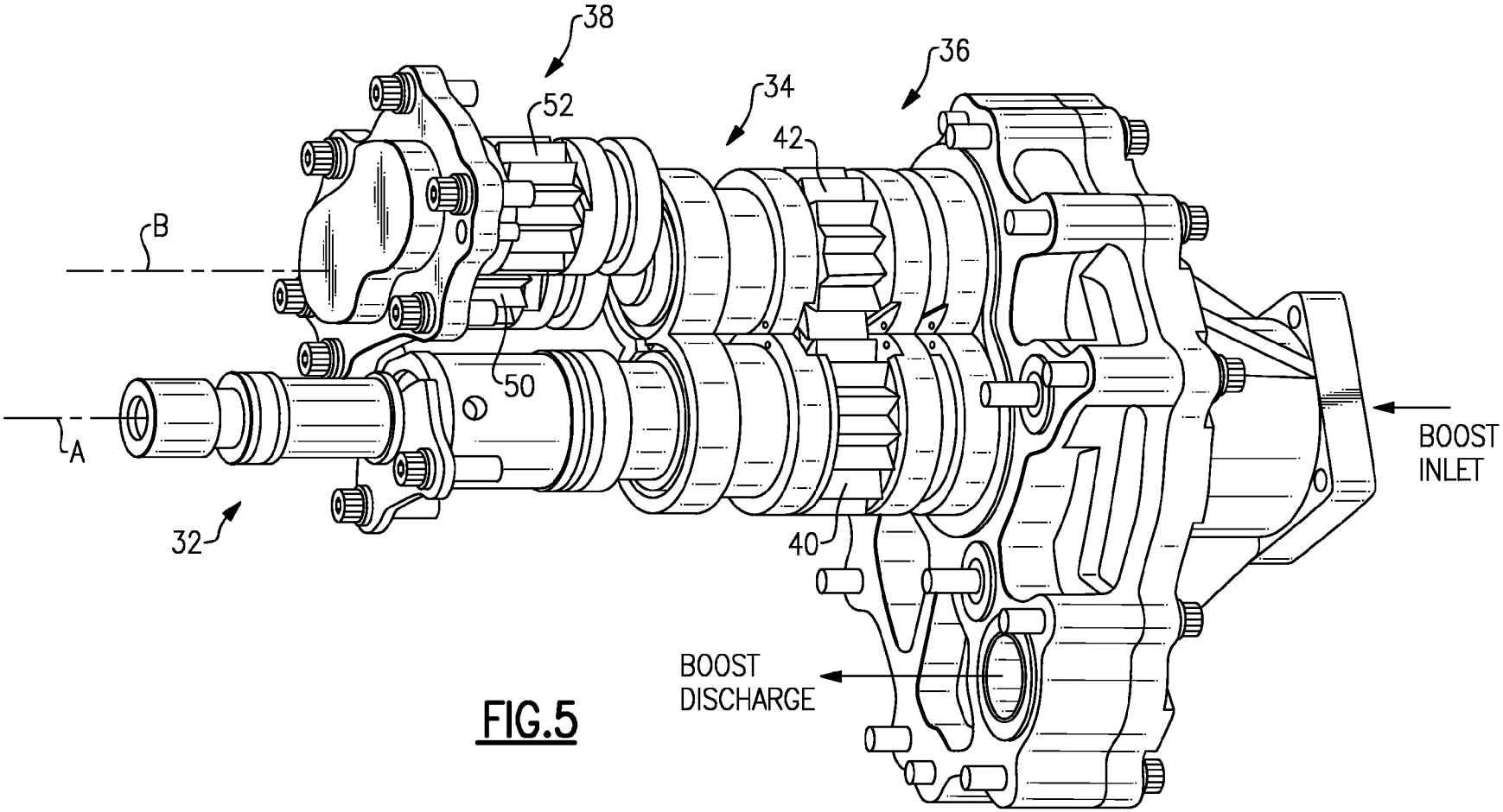
FIG. 5 is a perspective view of the gear pump with the housing removed.
Figure 6:
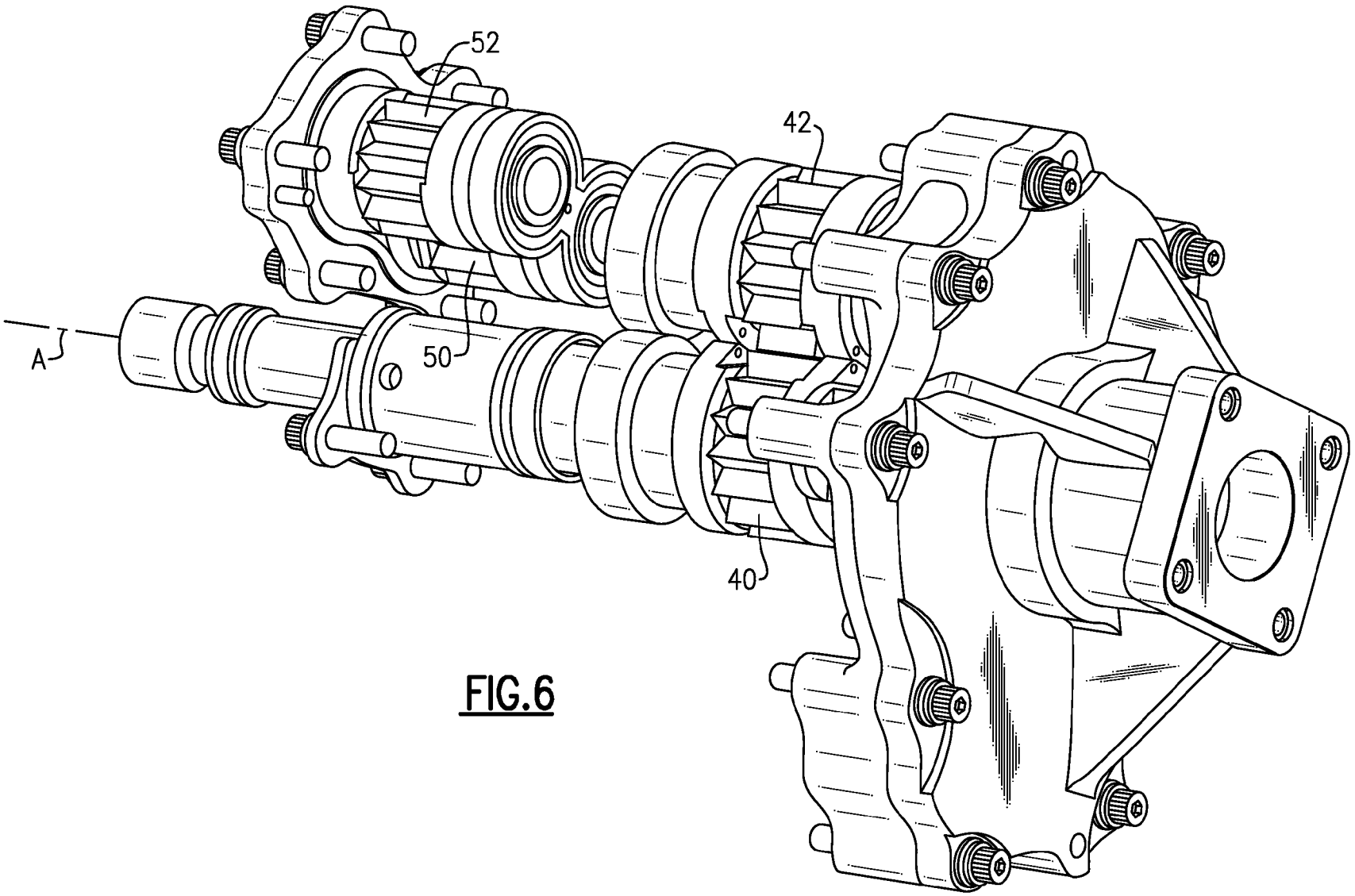
FIG. 6 is another perspective view of the gear pump with the housing removed.
Figure 7:
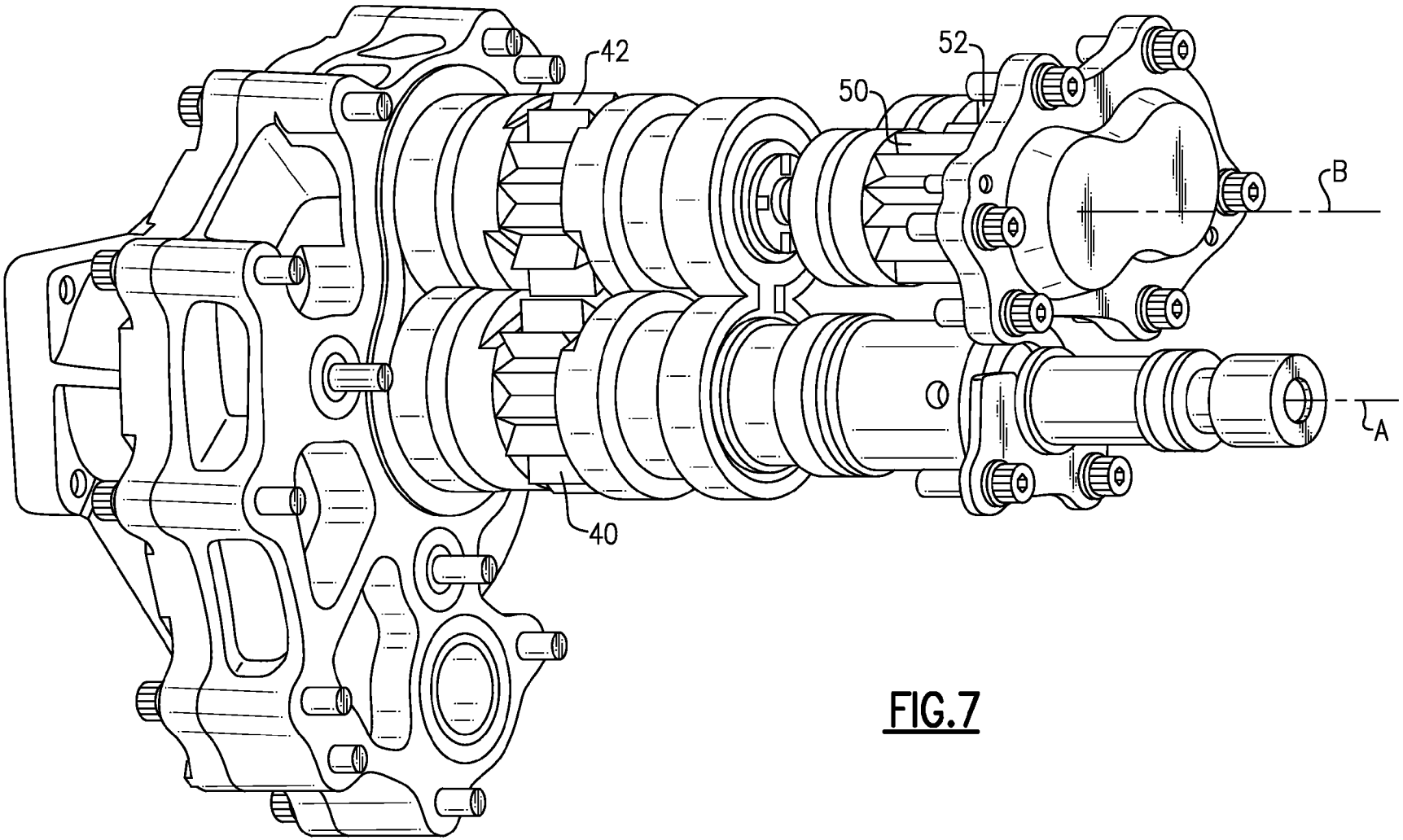
FIG. 7 is another perspective view of the gear pump with the housing removed.

The main drive gear 40 is in meshed engagement with the main driven gear 42 and the motive drive gear 50 is in meshed engagement with the motive driven gear 52 (FIGS. 5-7). The input shaft assembly 32 drives the coupling shaft assembly 34 through the main stage 36 to drive the motive stage 38. A boost stage 58 is also driven by the input shaft assembly 32 to define a centrifugal pump with an impeller and integrated inducer.

Figure 8:
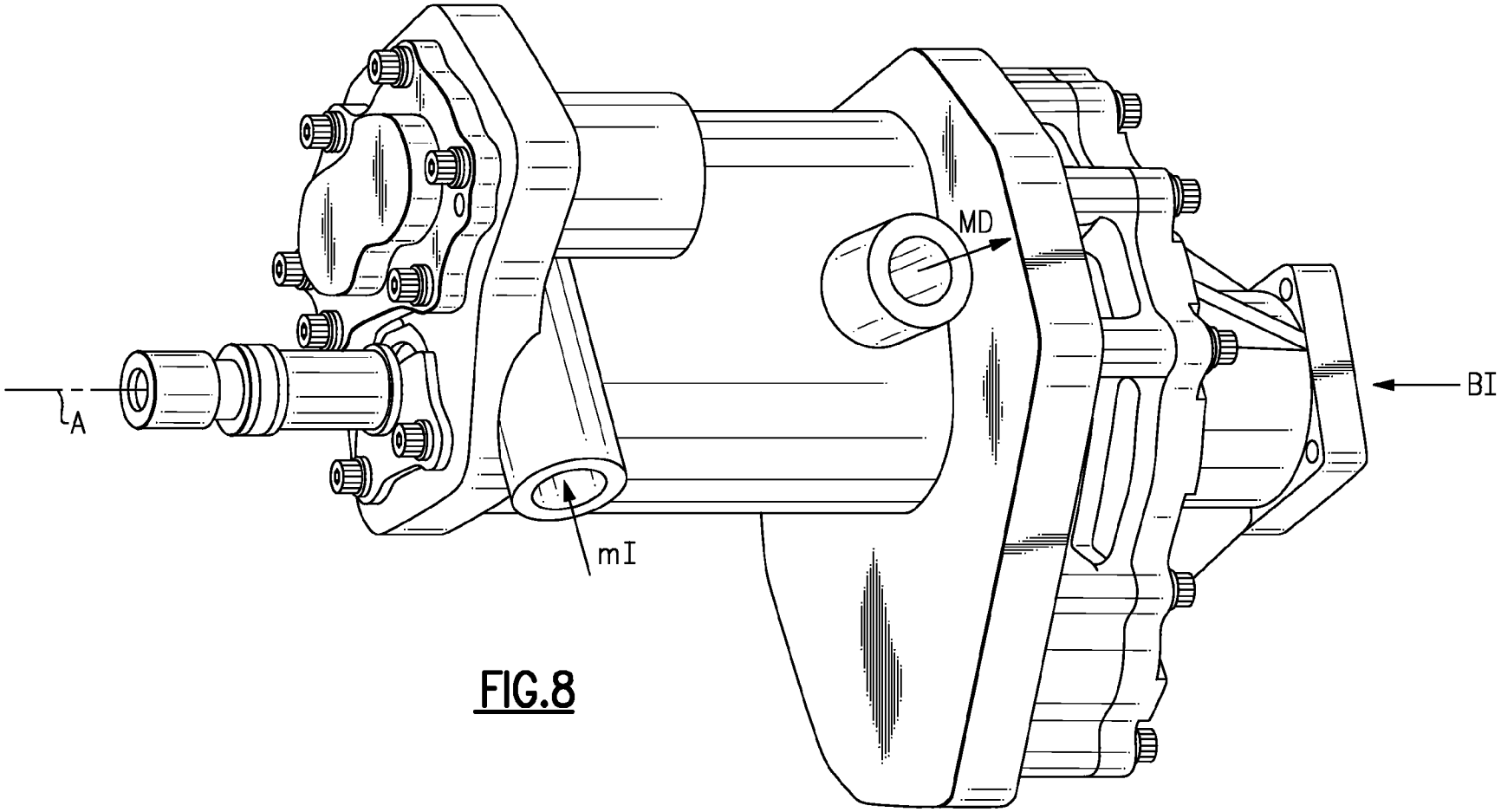
FIG. 8 is a perspective view of the gear pump from the same perspective as in FIG. 5.
Figure 9:
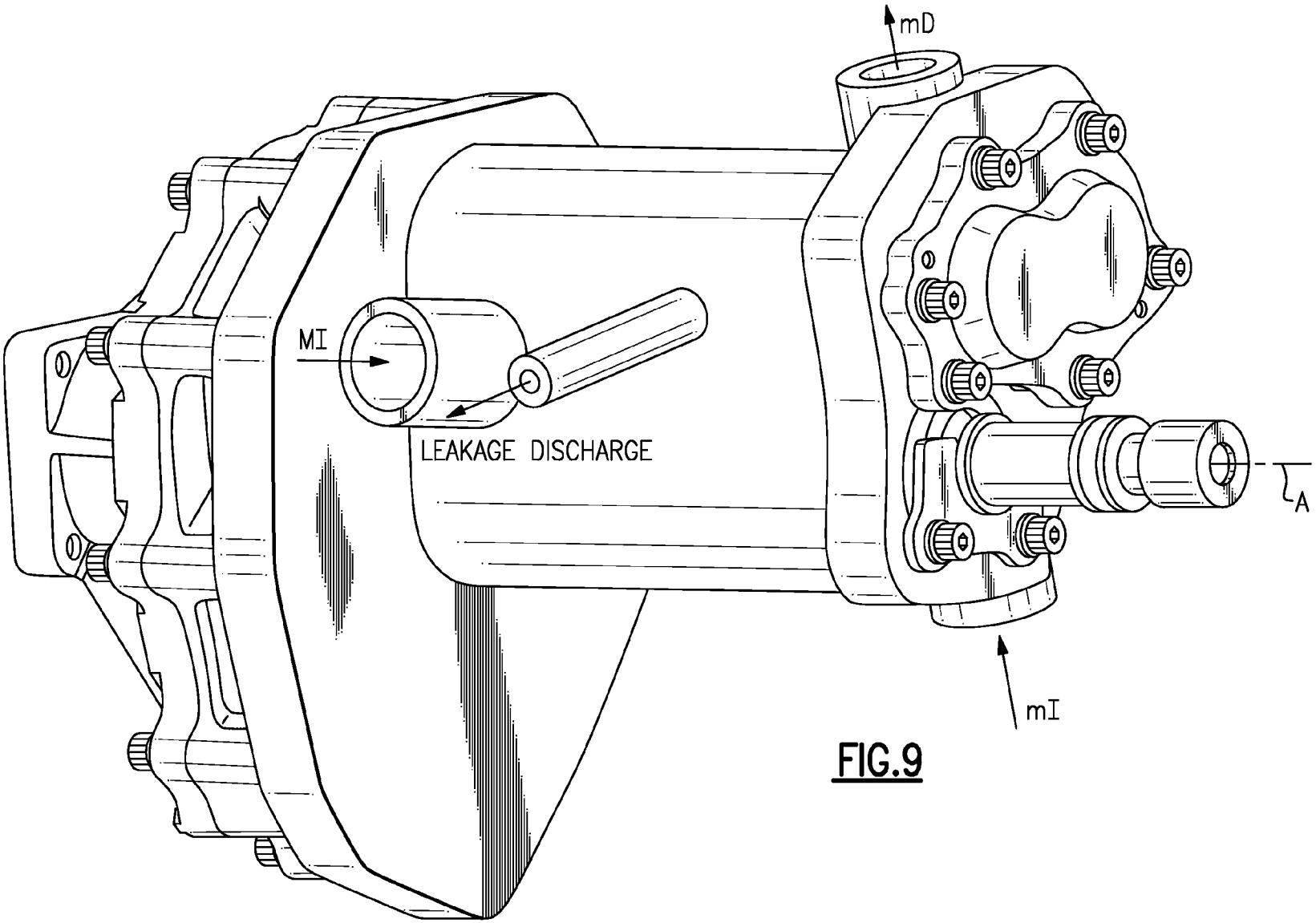
FIG. 9 is a perspective view of the gear pump from the same perspective as in FIG. 7.
Figures 10, 12:
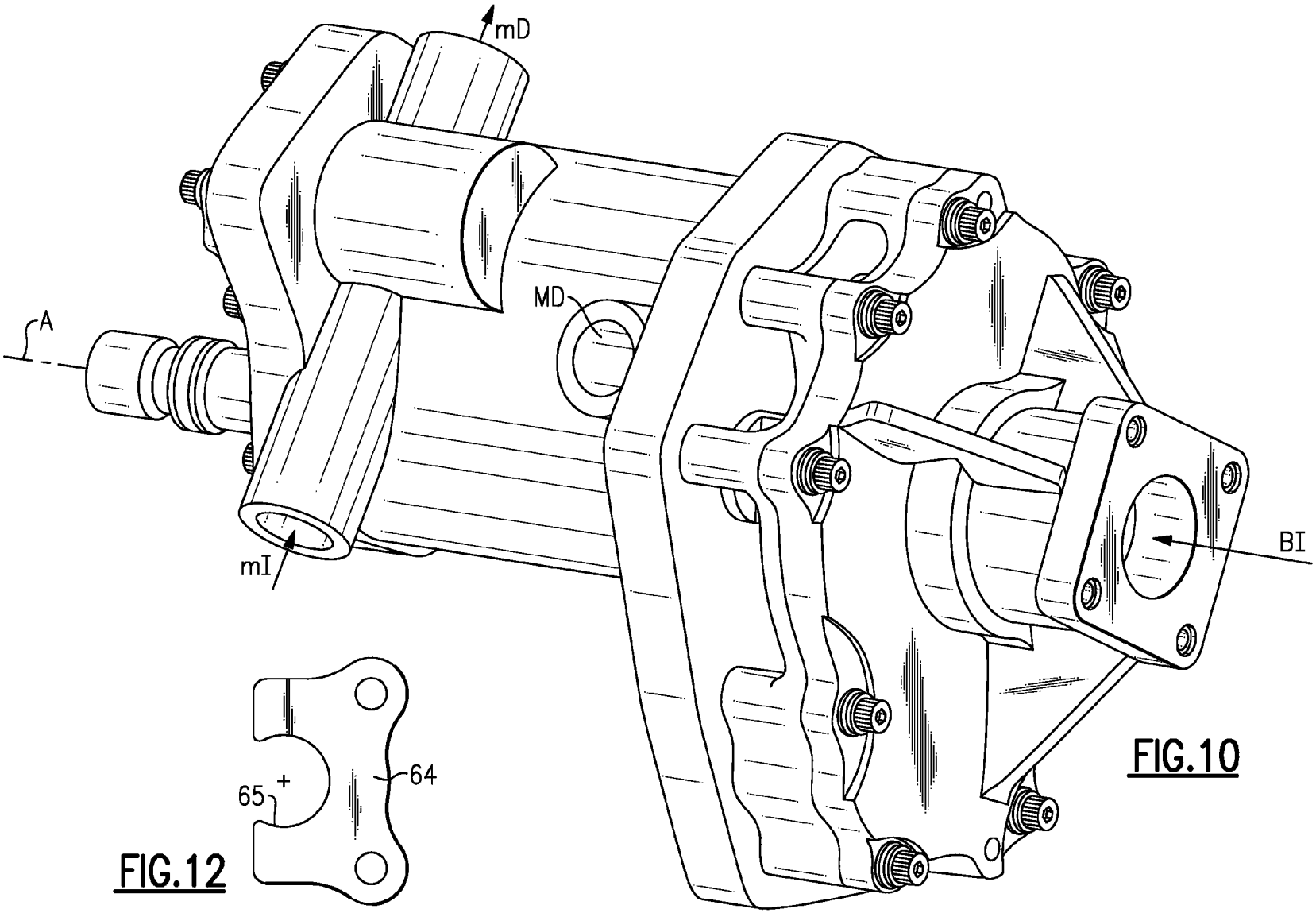
FIG. 10 is a perspective view of the gear pump from the same perspective as in FIG. 6.
FIG. 12 is an end view of a retainer plate of the input shaft assembly.

The stages 36, 38, 58 work mostly independently. Each stage 36, 38, 58 includes a separate inlet and discharge (FIGS. 8-10). As the meshed gears 40, 42 and 50, 52 rotate, respective volumes of fluid are communicated from the main stage inlet MI to the main stage discharge MD and from a motive stage inlet mI to a motive stage discharge mD such that the main stage 36 communicates a main fuel flow while the motive stage 38 supplies a motive fuel flow. The main stage inlet MI and main stage discharge MD as well as the motive stage inlet mI and motive stage discharge mD are respectively directed along generally linear paths through the respective gear stage 36, 38.

In the disclosed non-limiting embodiment, an aircraft fuel system provides flow and pressure to the boost stage inlet BI. A portion of the boost stage discharge is routed internally to the motive stage inlet mI. The remainder of the boost stage discharge is discharged from the gear pump 20 to the aircraft fuel system, then returns to the main stage inlet MI. The motive stage discharge mD is communicated to the aircraft fuel system. The main stage discharge MD is also communicated to the aircraft fuel system to provide at least two main functions: actuation and engine burn flow. There may be alternative or additional relatively minor flow directions and functions, but detailed description thereof need not be further disclosed herein.

Figure 11:
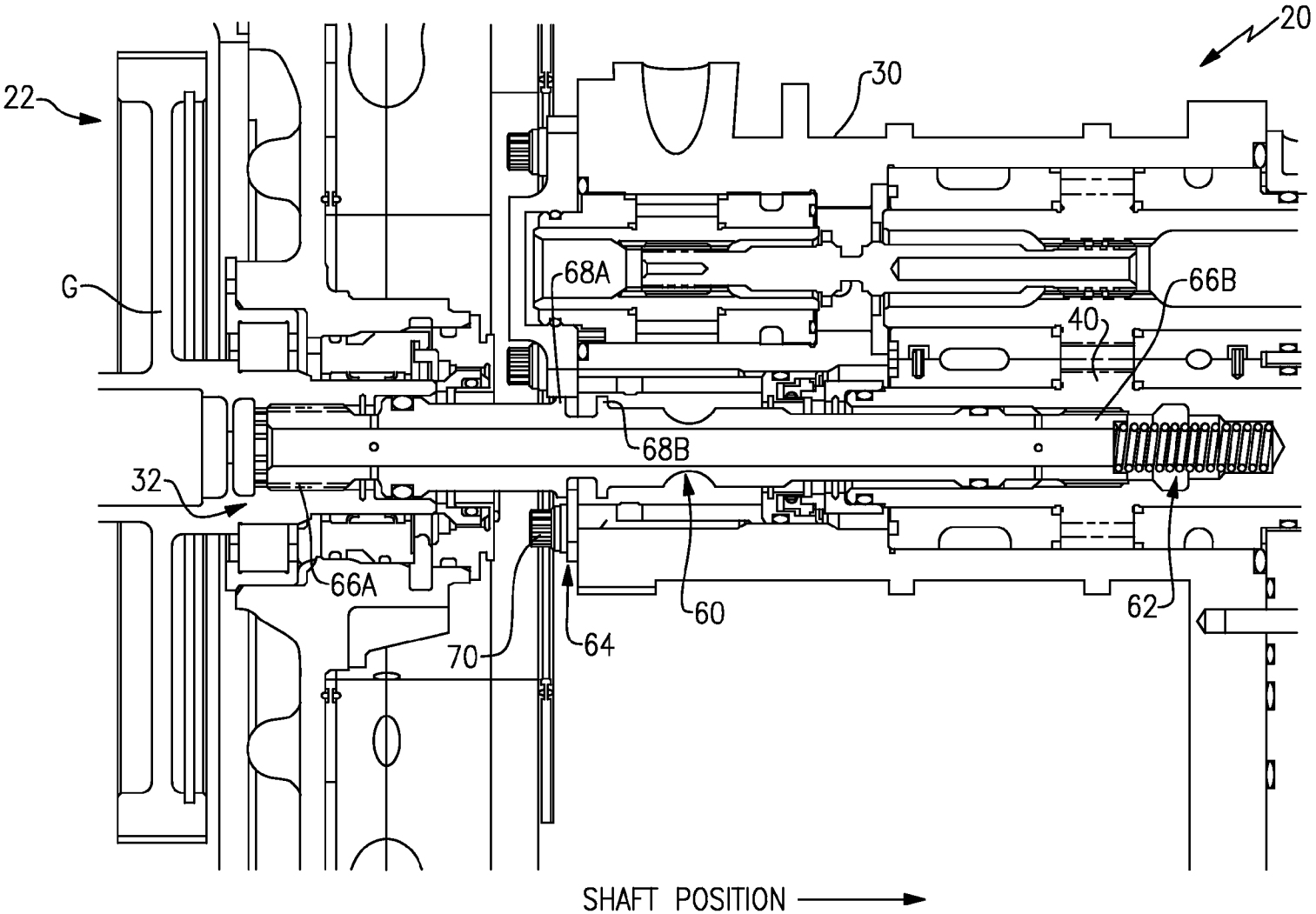
FIG. 11 is an expanded sectional view of an input shaft assembly of the gear pump.

With reference to FIG. 11, the input shaft assembly 32 includes an input shaft 60, a spring 62 and a retainer plate 64. The input shaft 60 is a hollow shaft with splined end sections 66A, 66B and radial shoulders 68A, 68B therebetween. The splined end section 66A plugs into a gear G of the accessory gearbox 22. The splined end section 66B interfaces with the main drive gear 40.

The radial shoulders 68A, 68B are generally aligned with the housing 30 to receive the retainer plate 64 therebetween. The retainer plate 64 is attached to the housing 30 through fasteners 70 such as bolts (also illustrated in FIG. 2) to position an interrupted opening 65 between the radial shoulders 68A, 68B. The interrupted opening 65 in one disclosed non-limiting embodiment is an arcuate surface with an interruption less than 180 degrees (FIG. 12). The axial position of the input shaft 60 is thereby axially constrained by the interaction of the radial shoulders 68A, 68B and to the retainer plate 64.

Oftentimes, impact loads may be applied to the gear pump 20 through the input shaft assembly 32 during installation onto the accessory gearbox 22. That is, while the gear pump 20 is being mounted to the accessory gearbox 22, the input shaft assembly 32 may not be properly aligned to engage with the gear G which may result in impact loads to the input shaft assembly 32 and thereby to the internals of the gear pump 20. In addition, impact loads may be applied during shipping and handling of the gear pump 20. In order to meet all performance requirements throughout the pump service life, the gear pump 20 must withstand these loads periodically over time without causing any damage.

Figure 13:
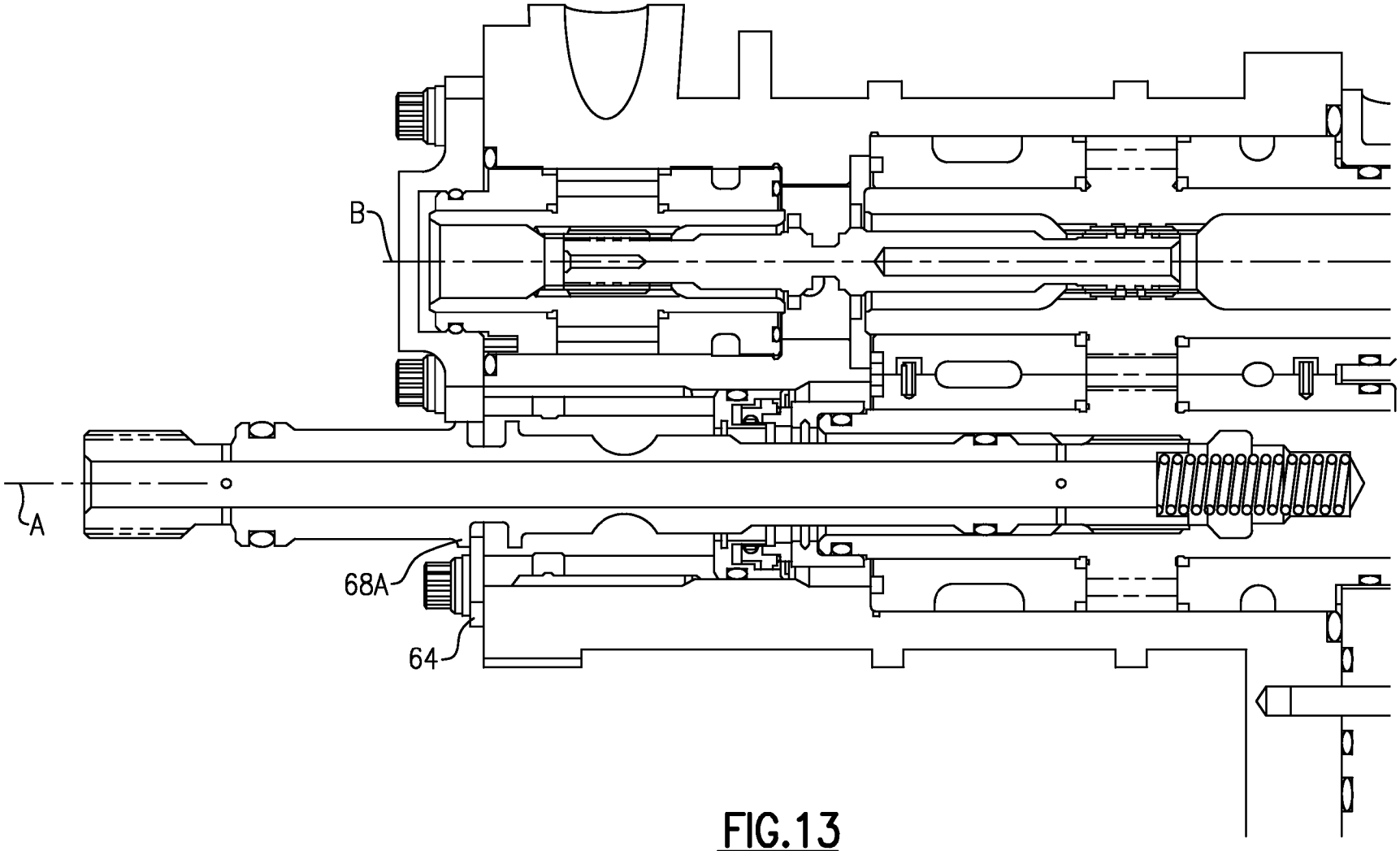
FIG. 13 is an expanded sectional view of an input shaft assembly of the gear pump while being installed into an accessory gearbox.

When an impact load is applied to the input shaft assembly 32, shoulder 68A on the side of the accessory gearbox 22 bottoms on the retainer plate 64 (FIG. 13). The impact load is thereby transmitted from the retainer plate 64 and into the housing 30 which readily withstands the load. Shoulder 68B on the side of the housing 30 may also bottom on the retainer plate 64 should the input shaft 60 be extended too far from the housing 30 to ensure that the input shaft 60 remains properly installed irrespective of rough handling, during installation and removal of the gear pump 20 on the accessory gearbox 22, and shipping and handling of the gear pump 20.

Figure 14:
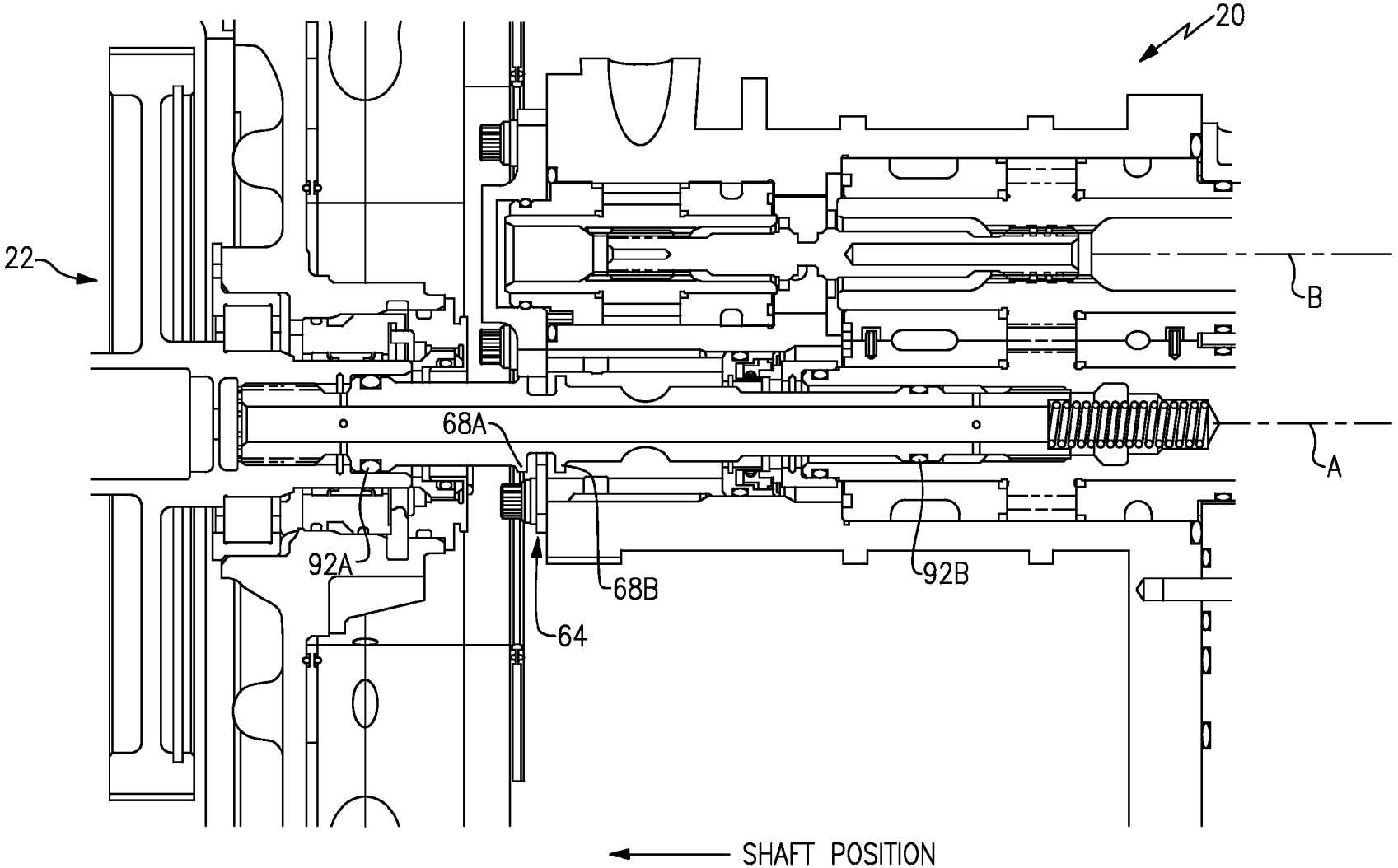
FIG. 14 is an expanded sectional view of an input shaft assembly of the gear pump in an operational position.

With reference to FIG. 14, the spring 62 biases the input shaft 60 of the input shaft assembly 32 to position the input shaft 60 during gear pump operation. That is, the spring 62 allows the input shaft 60 to move in the housing 30 in response to impact loads, until the input shaft 60 bottoms out on the retainer plate 64, but during operation, the spring 62 positions the input shaft 60 such that the radial shoulders 68A, 68B are spaced from the retainer plate 64. This assures there are no rotational to stationary part contact during operation.

Figure 15:
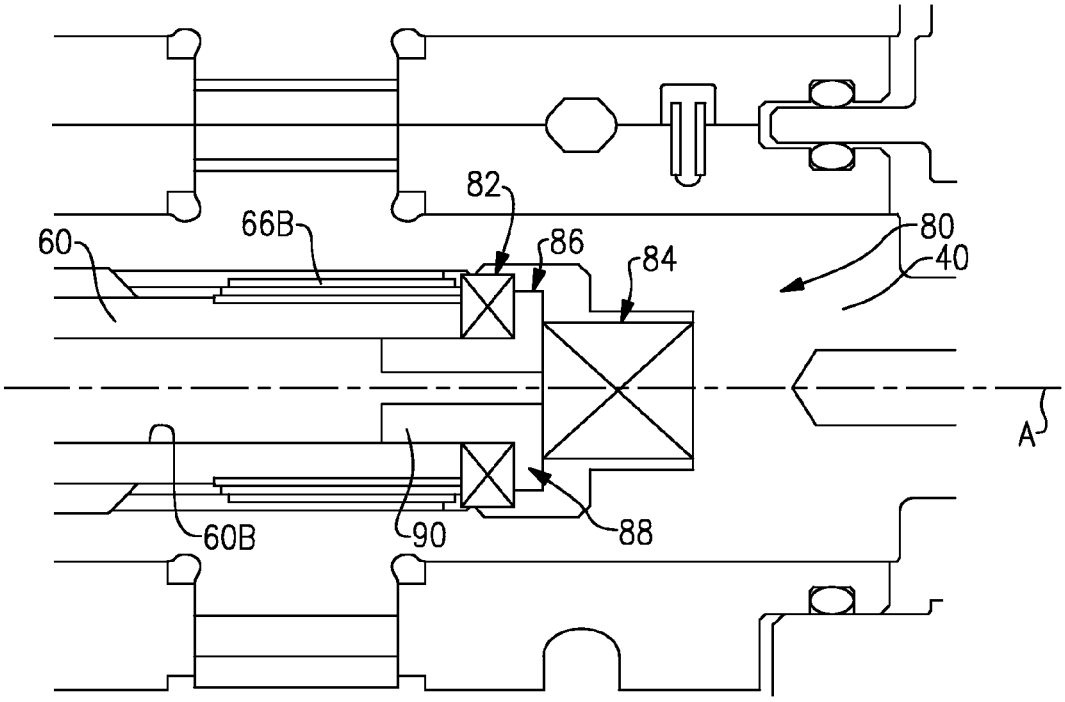
FIG. 15 is an expanded sectional view of another embodiment of a spring assembly of the input shaft assembly.

With reference to FIG. 15, a spring assembly 80 according to another non-limiting embodiment generally includes a wave spring 82, a coil spring 84 and a spring guide 86. The spring guide 86 includes a shoulder 88 which abuts an end section of the input shaft 60 and a cylindrical portion 90 which extends at least partially into a hollow inner bore 60B of the input shaft 60. The wave spring 82 is located between the shoulder 88 and the end section of the input shaft 60. The coil spring 84 is located between the spring guide 86 and the main drive gear 40.

The spring assembly 80 provides a relatively high initial load to bias the input shaft 60 against the friction forces generated by the elastomeric seals 92A and 92B (FIG. 14) mounted on the input shaft 60. The spring guide 86 is in contact with the coil spring 84 which is a relatively lower rate spring that is compressed as the input shaft 60 is mounted into the gear G. This coil spring 84 provides the relatively constant load to assure the input shaft 60 does not contact the retainer plate 64 during operation (FIG. 14).

Once installed, the input shaft 60 is moved out of contact with the retainer plate 64 by the wave spring 82 and the coil spring 84 then provides a relatively constant smaller bias toward the gear G. This facilitates position maintenance of the input shaft 60 for the gear G which may utilize roller bearings with limited capability to support an axial load during operation. That is, the input shaft 60 is loaded by the relatively low rate coil spring 84 to maintain a minimum thrust load bias upon the input shaft 60 toward the accessory gearbox 22.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A shaft assembly comprising:

a rotatable shaft defining a first radial shoulder and a second radial shoulder; and a retainer plate at least partially between said first radial shoulder and said second radial shoulder, said rotatable shaft being axially moveable over a range defined by said first radial shoulder and said second radial shoulder, respectively, bottoming on said retainer plate.

2. The shaft assembly as recited in claim 1, wherein said shaft is hollow.

3. The shaft assembly as recited in claim 1, wherein said first radial shoulder and said second radial shoulder are both located between a first splined end section and a second splined end section.

4. The shaft assembly as recited in claim 1, wherein said retainer plate is mountable to a gear pump housing.

5. The shaft assembly as recited in claim 1, wherein said retainer plate defines an interrupted opening.

6. The shaft assembly as recited in claim 5, wherein said interrupted opening is an arcuate surface with an interruption of less than 180 degrees.

7. The shaft assembly as recited in claim 1, further comprising a spring which biases said shaft along an axis of said shaft.

8. The shaft assembly as recited in claim 7, wherein said spring abuts an end section of said shaft.

9. A shaft assembly comprising:

a shaft with a first radial shoulder and a second radial shoulder;

a spring guide in contact with said shaft;

a first spring between said spring guide and said shaft; and a second spring in contact with said spring guide.

10. The shaft assembly as recited in claim 9, wherein said shaft is hollow, and said spring guide extends at least partially into said hollow.

11. The shaft assembly as recited in claim 9, wherein said first spring is a wave spring between a shoulder of said spring guide and said shaft.

12. The shaft assembly as recited in claim 11, wherein said second spring is a coil spring.

13. The shaft assembly as recited in claim 11, wherein said second spring extends between said spring guide and a gear.

14. A gear pump comprising:

a gear pump housing;

an input shaft which at least partially extends from said gear pump housing along an input shaft axis, said input shaft defines a first radial shoulder and a second radial shoulder; and a retainer plate mounted to said gear pump housing, said retainer plate located at least partially between said first radial shoulder and said second radial shoulder to restrain an axial position of said input shaft.

15. The gear pump as recited in claim 14, further comprising a coupling shaft assembly mounted within said gear pump housing along a coupling shaft axis, said coupling shaft axis located parallel to said input shaft axis.

16. The gear pump as recited in claim 14, wherein said retainer plate is removably mountable to said gear pump housing.

17. The gear pump as recited in claim 16, wherein said retainer plate defines an interrupted opening.

18. The gear pump as recited in claim 17, wherein said interrupted opening is an arcuate surface with an interruption of less than 180 degrees.

19. A method of installing an input shaft within a housing comprising:

positioning the input shaft to at least partially extend from the housing along an input shaft axis, the input shaft defines a first radial shoulder and a second radial shoulder; and attaching a retainer plate to the housing, the retainer plate located at least partially between the first radial shoulder and the second radial shoulder to restrain an axial position of the input shaft.

20. A method as recited in claim 19, further comprising:

spring biasing the input shaft.

* * * * *